United States Patent [19]

Lorenz

[11] 4,455,109

[45] Jun. 19, 1984

[54] BARGE HULL FOR OFFSHORE DRILLING RIGS

[75] Inventor: David B. Lorenz, Houston, Tex.

[73] Assignee: Marathon Manufacturing Company, Houston, Tex.

[21] Appl. No.: 259,714

[22] Filed: May 1, 1981

[51] Int. Cl.[3] ..... E02B 17/08; B63B 1/32

[52] U.S. Cl. ..... 405/203; 405/196; 114/288

[58] Field of Search ..... 405/203, 204, 205, 206, 405/207, 208, 209, 196; 114/288, 290, 26, 264, 265

[56] References Cited

U.S. PATENT DOCUMENTS

| | | | |
|---|---|---|---|
| D. 193,453 | 8/1962 | Siegel | 114/288 X |
| 1,396,831 | 11/1921 | Gardner | 114/288 |
| 1,710,904 | 4/1929 | Titcomb | 114/288 |
| 2,269,801 | 1/1942 | Willrich, Jr. | 114/288 |
| 2,724,358 | 11/1955 | Harris et al. | 114/26 X |
| 2,791,980 | 5/1957 | Best, Jr. | 114/26 X |
| 3,593,529 | 7/1971 | Smulders | 405/209 |
| 3,628,336 | 12/1971 | Moore et al. | 405/196 |
| 3,996,869 | 12/1976 | Hadley | 114/290 |
| 4,103,503 | 8/1978 | Smith | 405/196 |
| 4,192,248 | 3/1980 | Moyer | 114/288 X |

FOREIGN PATENT DOCUMENTS

| | | | |
|---|---|---|---|
| 54-27199 | 3/1979 | Japan | 405/196 |

OTHER PUBLICATIONS

"New Rig Concepts Focus on Fast Moves," *The Oil and Gas Journal*, Feb. 26, 1968, pp. 53–54.

*Primary Examiner*—James A. Leppink
*Assistant Examiner*—Beverly E. Hjorth
*Attorney, Agent, or Firm*—Vinson & Elkins

[57] ABSTRACT

An improved barge hull for offshore drilling rigs is disclosed. The invention comprises a channel in the bottom of a barge hull extending from the bottom of said barge hull to the back of said barge hull for directing the flow of water under said barge hull to the back of said barge hull in order to disrupt the relative hydrodynamic stability of a body of water immediately behind said barge hull and thereby decrease the towing resistance of said barge hull.

6 Claims, 4 Drawing Figures

BARGE HULL FOR OFFSHORE DRILLING RIGS

This invention relates to offshore drilling rigs, and more particularly, to an improved barge hull for such rigs which provides decreased towing resistance as said rigs are being towed to and from drilling sites.

BACKGROUND OF THE INVENTION

Most of the offshore drilling rigs used in the oil and gas producing industry are of the jack-up type. A jack-up type off-shore drilling rig generally comprises a floatable barge having three or more legs vertically disposed through said barge which may be lowered to the bottom of a body of water for supporting said barge above the surface of said body of water. The offshore drilling rig is elevated or "jacked-up" on its supporting legs during oil and gas producing operations.

An offshore drilling rig typically spends approximately ninety percent to ninety-five percent of its working life in an elevated position. The remainder of the time is spent in transit moving from one drilling site to another. Typically, offshore drilling rigs are not self propelled and must be towed to and from drilling sites by large tugs. Normally, the time it takes to tow an offshore drilling rig from one site to another is not productive time for the owners of the offshore drilling rig. Because an offshore drilling rig generally does not generate revenue during the time it is in transit, it is desirable to make the transit time as short as possible. Therefore, any increase which may be achieved in the speed at which an offshore drilling rig may be towed is highly desirable.

The towing speed of an offshore drilling rig may be increased by decreasing the towing resistance of the barge hull of the offshore drilling rig. Because the towing resistance of any particular barge hull is related to the shape of that barge hull, it is possible to reduce the towing resistance of a particular type of barge hull by making changes in the barge hull's structural design. Unfortunately, many of the structural designs that would reduce towing resistance in a barge hull are either impractical or far too expensive in construction.

The present invention is directed toward providing an inexpensive means for reducing towing resistance in an offshore drilling rig barge hull. A major portion of the towing resistance in a barge hull is due to what is referred to as "form drag." Form drag refers to the frictional forces acting on the towed structure that are specifically attributable to the shape or form of the towed structure. The shape of an offshore drilling rig barge hull is usually either triangular or rectangular. In the case of either a triangularly shaped barge hull or a rectangularly shaped barge hull the rear edge of said barge hull as said barge hull is being towed is generally perpendicular to the direction in which said barge hull is being towed. Said rear edge is generally formed having a vertically disposed flat surface extending laterally across the width of the rearmost portion of said barge hull and extending vertically from the bottom to the top of said barge hull.

The hydrodynamic forces of the water moving past the ends of the rear edge of a barge hull cause a suction effect that tends to retain a relatively large body of water immediately behind the barge hull as it is being towed. The natural flow lines of fluid around and under such a barge hull do not generate a sufficiently large amount of hydrodynamic turbulence to cause the water immediately behind the barge hull to flow away from the barge hull. In effect, a large amount of water is being towed along with and behind the barge hull.

SUMMARY OF THE INVENTION

The present invention comprises a structural modification to the bottom of the barge hull of an offshore drilling rig. The structural modification consists of forming the bottom of said barge hull with a channel extending from the bottom of said barge hull to the back of said barge hull for directing the flow of water under said barge hull to the back of said barge hull in order to create hydrodynamic turbulence sufficient to disrupt the relative hydrodynamic stability of a body of water immediately behind said barge hull when said barge hull is being towed.

It is an object of this invention to provide a simple, efficient and economical means for reducing towing resistance in an offshore drilling rig barge hull or the like.

Another object of this invention is to provide means for generating a sufficiently large amount of hydrodynamic turbulence in the flow of water flowing from under a towed offshore drilling rig to cause a relatively stagnant body of water behind said towed drilling rig to be dispersed and move away from said towed barge hull of said drilling rig.

A further object of this invention is to provide a channel in the bottom of a barge hull of an offshore drilling rig, said channel extending from the bottom of said barge hull to the back of said barge hull, for directing the flow of water under said barge hull to the back of said barge hull in order to reduce a suction effect that tends to retain a relatively large body of water immediately behind said barge hull as said barge hull is being towed.

A still further object of this invention is to provide a channel in the bottom of a barge hull of an offshore drilling rig, said channel extending from the bottom of said barge hull to the back of said barge hull, for directing the flow of water under said barge hull to the back of said barge hull in order to generate a sufficiently large amount of hydrodynamic turbulence in the flow of water flowing from under said barge hull to cause the water immediately behind said barge hull to move away from said barge hull as said barge hull is being towed.

These and other objects and features of advantage of the invention will be apparent from the drawings, the detailed description, and the appended claims.

BRIEF DESCRIPTION OF THE DRAWINGS

In the drawings in which is shown a preferred embodiment the invention may assume, and which like numerals indicate like parts.

DESCRIPTION OF THE PREFERRED EMBODIMENT

Figure 1:
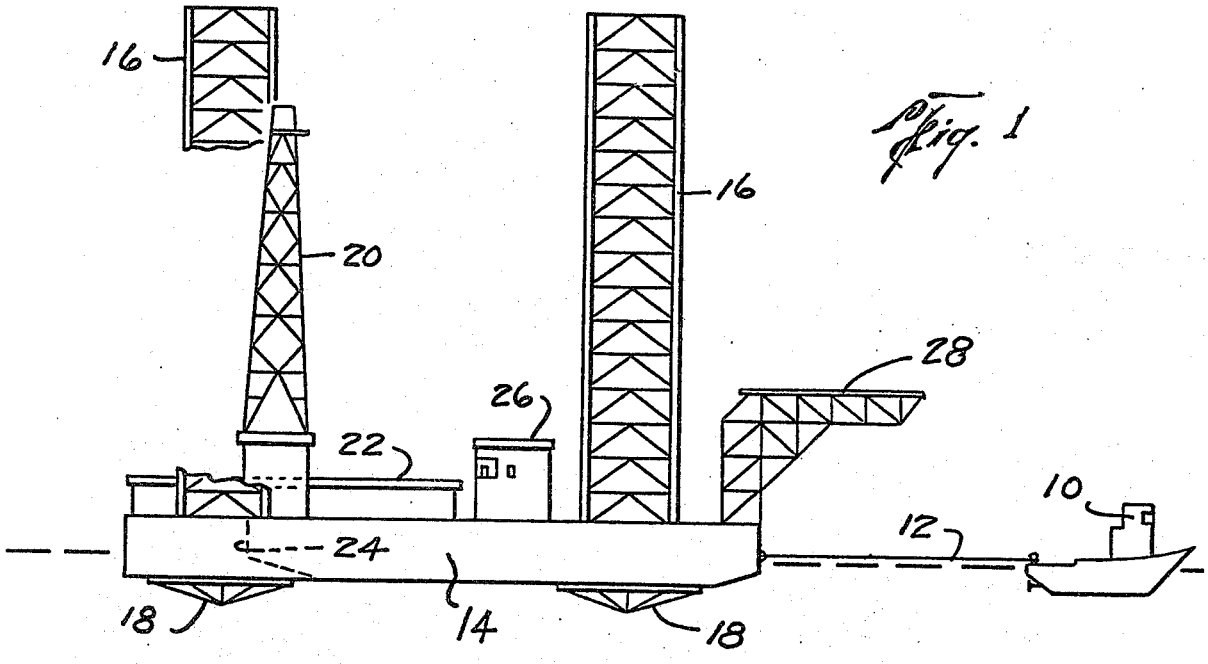
FIG. 1 is a schematic side view of an offshore drilling rig being towed.

FIG. 1 depicts an offshore drilling rig under tow. An ocean going tug 10 tows said rig with a tow line 12 attached to the floating barge hull 14 of said rig. As schematically shown in FIG. 1, the drilling rig legs 16 are raised into stowed position with respect to said barge hull 14. Only the feet 18 of the drilling rig legs 16 protrude slightly beneath the generally flat bottom of said barge hull 14 when said legs 16 are raised into stowed position for transit.

Barge hull 14 provides support for the equipment necessary for drilling or workover operations. Such equipment generally includes derrick 20 and may include a cantilever beam 22 for slidably extending said derrick 20 over a drilling slot 24 formed in the periphery of barge hull 14 or for slidably extending said derrick 20 over the periphery of barge hull 14 in a rig not having a drilling slot 24. Barge hull 14 also provides support for crew quarters 26, helicopter landing pad 28 and other equipment not depicted in FIG. 1.

Figure 2:
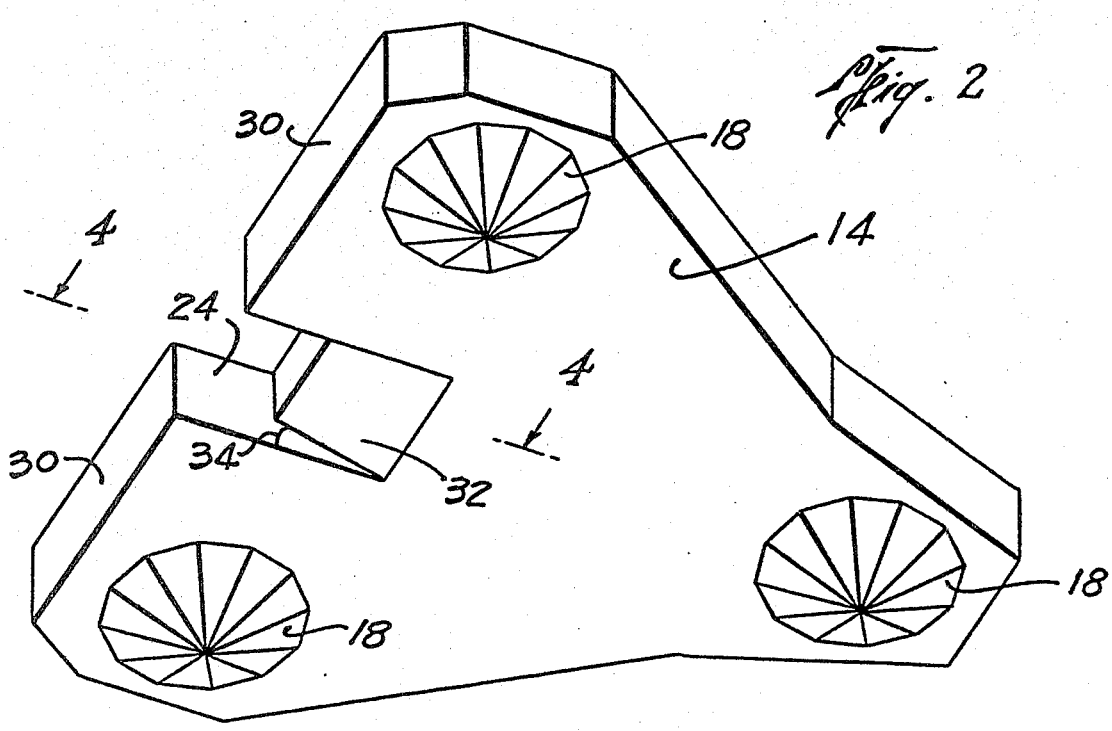
FIG. 2 is a schematic perspective view of the bottom of a barge hull of an offshore drilling rig having a drilling slot illustrating the improved barge hull form of the invention.
Figure 3:
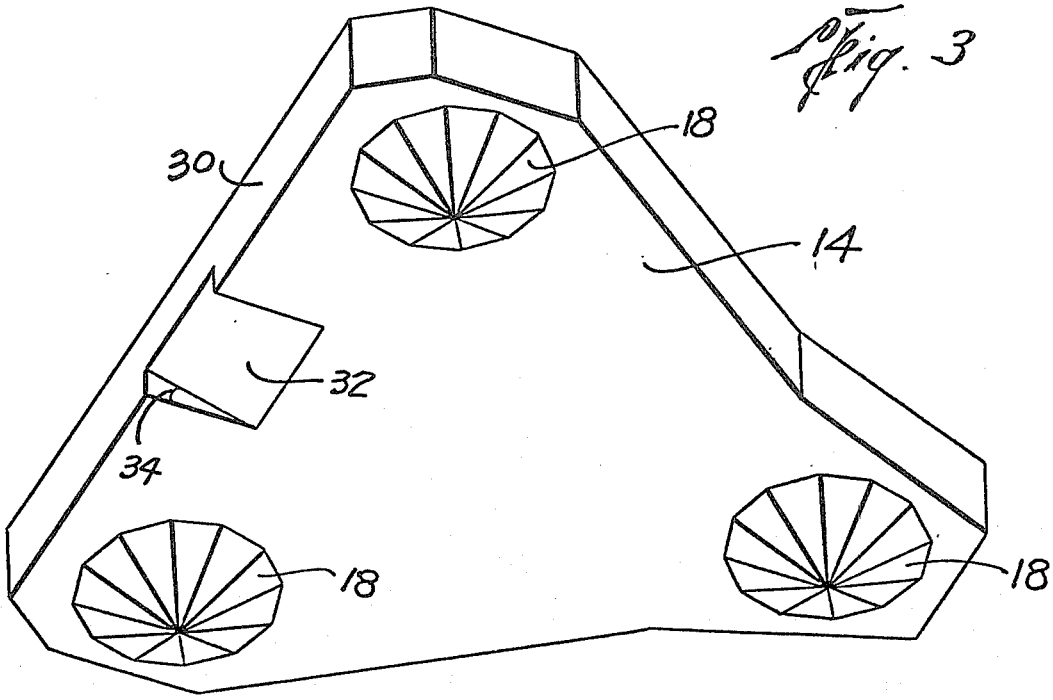
FIG. 3 is a schematic perspective view of the bottom of a barge hull of an offshore drilling rig not having a drilling slot illustrating the improved barge hull of the invention.

FIGS. 2 and 3 depict a schematic perspective view of the bottom of a triangularly shaped barge hull 14. The barge hull 14 shown in FIG. 2 is formed with a drilling slot 24 in the periphery of said barge hull to permit drilling or workover operations to be carried out at a location on barge hull 14 inboard of the rear edge 30 of said barge hull 14. The presence of drilling slot 24 in barge hull 14 divides the rear edge 30 of said barge hull 14 in two portions as shown in FIG. 2. The barge hull 14 shown in FIG. 3 has no drilling slot. Therefore, the rear edge 30 of said barge hull 14 extends laterally across the rear of said barge hull 14 in a continuous manner.

The numeral 32 generally denotes the channel of the present invention. As shown in FIGS. 2 and 3, channel 32 is formed in the bottom of a barge hull 14 by structurally forming portions of the bottom of said barge hull 14 to cause said channel 32 to extend from the bottom of said barge hull 14 to the rear edge 30 of said barge hull 14. Of course, in the case of a barge hull 14 having a drilling slot 24 as shown in FIG. 2, channel 32 intersects the space within said drilling slot 24 before reaching the rear edge 30 of said barge hull 14.

The bottom of said channel 32 is a substantially flat surface inclined at an angle between approximately eleven degrees and approximately fifteen degrees with respect to the bottom of said barge hull 14. The aforesaid angle is denoted by the numeral 34 in the drawings. The magnitude of angle 34 is well known in the prior art. The magnitude of said angle 34 has been previously used in the design of the rear end of barges to cause the flow of water from under the end of barges to be hydrodynamically efficient and low in turbulence. It has been established in the prior art that the utilization of angles outside the described range of angles results in reduced levels of efficiency of hydrodynamic flow thereby increasing frictional or "drag" forces present during the towing of a barge.

Figure 4:
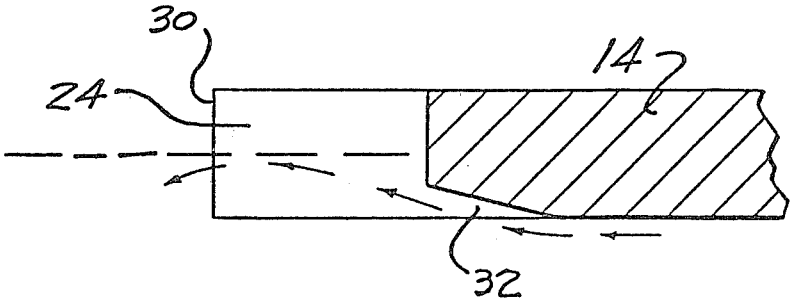
FIG. 4 is a schematic sectional view taken on the line 4—4 of FIG. 2 showing the path of fluid flow through the improved barge hull form of the invention.

In operation, the water passing under the bottom of barge hull 14 while said barge hull 14 is being towed flows upwardly along the inclined surface of said channel 32 and is discharged behind said barge hull 14 closer to the surface of the body of water through which the barge hull is being towed than would occur if said channel 32 did not exist in said barge hull 14. The upward deflection of water from beneath barge hull 14 through channel 32 into the area immediately behind the barge hull creates the turbulence necessary to break up the relatively stagnant body of water behind the towed barge hull 14. FIG. 4 depicts the path of fluid flow through channel 32 and into drilling slot 24 of the barge hull 14 shown in FIG. 2. It may be seen that the hydrodynamically efficient fluid flow through channel 32 lifts or upwardly deflects the flow of the water underneath said barge hull 14 as described. The surface of the body of water in which barge hull 14 is towed is shown as a dotted line in FIG. 4.

The width of channel 32 necessary to accomplish the desired result of disrupting the relatively stagnant body of water being towed behind barge hull 14 need not be as wide as the width of the back of said barge hull 14. In contradistinction to the prior art barge designs which taper the rear bottom surface of each barge all along the lateral extent of the rear of the barge, the design of the present invention utilizes a channel 32 of relatively narrow width. This is an advantageous feature because it is significantly more economical in the construction of barge hulls to construct a channel having a relatively narrow width as compared with constructing a similarly inclined surface all along the back of said barge hull.

A surprising feature of the design of the channel 32 of the present invention is that a relatively narrow channel 32 will achieve an efficient disruption of the relatively stagnant body of water being towed behind barge hull 14. The relative narrowness of channel 32 focuses the stream of water flowing through it onto the relatively stagnant body of water behind barge hull 14 and "punches a hole" through said relatively stagnant body of water thereby achieving the desired disruption and turbulence necessary to disengage said body of water from barge hull 14.

The prior art tapered end design previously used on the rear ends of conventional barges in which the tapered end extends all along the end of said barge has not been used on the barge hulls of offshore drilling rigs. The likely reason for this is that such a design could not be implemented on most barge hulls due to the presence of the drilling rig legs 16 in said barge hulls. As can be seen in FIG. 3, the width of channel 32 can be increased up to a point but the lateral extent of channel 32 can not extend all along the rear edge 30 of barge hull 14. The drilling rig legs 16 and feet 18 would structurally interfere with such a design and introduce unwanted hydrodynamic turbulence.

The solution presented in the design of the present invention is to limit the width of channel 32 so that channel 32 fits between the locations of drilling rig legs 16 in barge hull 14. It has been found that the relatively narrow width of channel 32 can accomplish significant reductions in the magnitude of the towing resistance of said barge hulls 14 as described above. It is not necessary as one would expect for channel 32 to have a relatively large width in order to achieve a significant improvement in reducing towing resistance.

While the design of the invention may be used on barges of any shape and function, it has been noted that the invention is particularly useful in providing reduced towing resistance in the barge hulls of triangularly shaped offshore drilling rigs. The triangular design common in many offshore drilling rigs provides both stability and strength in the structure. However, the triangular design of the barge hull in offshore drilling rigs has been found to exhibit high levels of towing resistance. Consider, for example, that the length to breadth ratio in a towed structure having the approximate shape of an equilateral triangle is much less than the length to breadth ratio of ordinary ships or barges. Specifically, the length to maximum breadth ratio of an equilateral triangle towed by one apex would be approximately equal to one-half the square root of 3 or approximately 0.866. In contrast, the length to maximum breadth ratio of a ship or barge 400 feet long having a maximum breadth of 100 feet is approximately 4.0. Thus it may be seen that a barge hull having the approximate shape of an equilateral triangle has a relatively greater resistance to towing by virtue of the fact that it has a greater lateral extent compared to its length than do vessels having a large length to maximum breadth ratio. Because the great majority of offshore drilling rigs are of the triangular type, the improved barge hull design of the invention can achieve significant savings in towing costs for numerous offshore drilling rigs even if its application were to be limited primarily to triangularly shaped drilling rigs.

What is claimed is:

1. A barge hull for an offshore drilling rig including a barge hull body having a substantially flat bottom; and means forming a channel in the bottom of said barge hull body for directing the flow of water under said barge hull body to the back of said barge hull to reduce the towing resistance of said barge hull, the top of said channel being formed by a substantially flat portion of said barge hull body extending from the substantially flat bottom of said barge hull body to the back of said barge hull body and inclined at an angle between approximately 11 degrees and approximately 15 degrees with respect to the bottom of said barge hull body, said channel having a width which is less than one half of the overall width of the back of said barge hull.

2. A barge hull for an offshore drilling rig including a barge hull body having a substantially flat bottom;

a plurality of drilling rig legs substantially vertically disposed within said barge hull body for supporting said barge hull above the surface of a body of water, each of said plurality of drilling rig legs extending through said barge hull body;

means forming a channel in the bottom of said barge hull body in a space between at least two of said plurality of drilling rig legs extending through said barge hull body, for directing the flow of water under said barge hull body to the back of said barge hull to reduce the towing resistance of said barge hull, the top of said channel being formed by a substantially flat portion of said barge hull body extending from the substantially flat bottom of said barge hull body to the back of said barge hull body and inclined at an angle between approximately 11 degrees and approximately 15 degrees with respect to the bottom of said barge hull body, said channel having a width which is less than one half of the overall width of the back of said barge hull.

3. A barge hull for an offshore drilling rig including a barge hull body having a substantially flat bottom and having a drilling slot in the back of said barge hull body; and means forming a channel in the bottom of said barge hull body for directing the flow of water under said barge hull body to the back of said barge hull to reduce the towing resistance of said barge hull, the top of said channel being formed by a substantially flat portion of said barge hull body extending from the substantially flat bottom of said barge hull body to the drilling slot of said barge hull body and inclined at an angle between approximately 11 degrees and approximately 15 degrees with respect to the bottom of said barge hull body, said channel having a width which is less than one half of the overall width of the back of said barge hull.

4. A barge hull for an offshore drilling rig including a barge hull body having a substantially flat bottom and having a drilling slot in the back of said barge hull body; and means forming a channel in the bottom of said barge hull body for directing the flow of water under said barge hull body to the back of said barge hull to reduce the towing resistance of said barge hull, the top of said channel being formed by a substantially flat portion of said barge hull body extending from the substantially flat bottom of said barge hull body to the drilling slot of said barge hull body and inclined at an angle between approximately 11 degrees and approximately 15 degrees with respect to the bottom of said barge hull body, said channel having a width which is equal to the width of said drilling slot.

5. A barge hull for an offshore drilling rig including a barge hull body having a substantially flat bottom and having a drilling slot in the back of said barge hull body;

a plurality of drilling rig legs substantially vertically disposed within said barge hull body for supporting said barge hull above the surface of a body of water, each of said plurality of drilling rig legs extending through said barge hull body; and means forming a channel in the bottom of said barge hull body in a space between at least two of said plurality of said drilling rig legs extending through said barge hull body, for directing the flow of water under said barge hull body to the back of said barge hull to reduce the towing resistance to said barge hull, the top of said channel being formed by a substantially flat portion of said barge hull body extending from the substantially flat bottom of said barge hull body to the drilling slot of said barge hull body and inclined at an angle between approximately 11 degrees and approximately 15 degrees with respect to the bottom of said barge hull body, said channel having a width which is less than one half of the overall width of the back of said barge hull.

6. A barge hull for an offshore drilling rig including a barge hull body having a substantially flat bottom and having a drilling slot in the back of said barge hull body;

a plurality of drilling rig legs substantially vertically disposed within said barge hull body for supporting said barge hull above the surface of a body of water, each of said plurality of drilling rig legs extending through said barge hull body; and means forming a channel in the bottom of said barge hull body in a space between at least two of said plurality of said drilling rig legs extending through said barge hull body, for directing the flow of water under said barge hull body to the back of said barge hull to reduce the towing resistance of said barge hull, the top of said channel being formed by a substantially flat portion of said barge hull body extending from the substantially flat bottom of said barge hull body to the drilling slot of said barge hull body and inclined at an angle between approximately 11 degrees and approximately 15 degrees with respect to the bottom of said barge hull body, said channel having a width which is equal to the width of said drilling slot.

* * * * *